US009295615B2

(12) United States Patent
Tollman

(10) Patent No.: US 9,295,615 B2
(45) Date of Patent: Mar. 29, 2016

(54) CAP FOR FEEDING BOTTLE

(71) Applicant: BB IPR Limited, Stanmore, Middlesex (GB)

(72) Inventor: Stephen Paul Tollman, Middlesex (GB)

(73) Assignee: BB IPR Limited, Stanmore, Middlesex (GB)

( * ) Notice: Subject to any disclaimer, the term of this patent is extended or adjusted under 35 U.S.C. 154(b) by 0 days.

(21) Appl. No.: 14/386,760

(22) PCT Filed: Mar. 27, 2013

(86) PCT No.: PCT/GB2013/050807

§ 371 (c)(1),
(2) Date: Sep. 19, 2014

(87) PCT Pub. No.: WO2013/144624

PCT Pub. Date: Oct. 3, 2013

(65) Prior Publication Data

US 2015/0069004 A1 Mar. 12, 2015

(30) Foreign Application Priority Data

Mar. 31, 2012 (GB) ..... 1205810.3

(51) Int. Cl.
*A61J 9/04* (2006.01)
*A61J 11/00* (2006.01)

(52) U.S. Cl.
CPC ..... *A61J 11/00* (2013.01); *A61J 11/006* (2013.01); *A61J 11/0035* (2013.01)

(58) Field of Classification Search
CPC ..... A61J 9/00; A61J 11/04; A61J 11/045; A61J 11/00; A61J 11/008
USPC ..... 215/11.1; 606/236, 234, 235; D24/117; 222/490
See application file for complete search history.

(56) References Cited

U.S. PATENT DOCUMENTS

| | | | | | |
|---|---|---|---|---|---|
| 589,212 | A * | 8/1897 | Michael | A61J 9/00 215/11.1 |
| 633,343 | A * | 9/1899 | Heany | A61J 11/0065 215/11.1 |
| 5,544,766 | A * | 8/1996 | Dunn | A61J 11/001 206/459.5 |
| 5,673,806 | A * | 10/1997 | Busnel | A61J 11/045 215/11.1 |
| 8,181,800 | B2 | 5/2012 | Rees et al. | |
| D668,767 | S * | 10/2012 | Stephan | D24/196 |
| 2003/0089676 | A1* | 5/2003 | Uehara | A61J 11/006 215/11.1 |
| 2008/0210655 | A1* | 9/2008 | Rees | A61J 11/006 215/11.5 |

(Continued)

FOREIGN PATENT DOCUMENTS

| | | | |
|---|---|---|---|
| DE | 3241845 | A1 | 5/1984 |
| EP | 1310230 | A3 | 11/2003 |

(Continued)

*Primary Examiner* — Fenn Mathew
*Assistant Examiner* — Cynthia Collado
(74) *Attorney, Agent, or Firm* — Andrew W. Chu; Craft Chu PLLC

(57) ABSTRACT

The removable cap for a feeding bottle is made from flexible plastics material with a smooth exterior surface which is soft to a baby's lips and chin and has an upstanding nipple open at the bottom and with an aperture at the top. The underside of the cap is provided with a plurality of spaced shallow indentations elliptical in shape and moulded into the plastics material. The indentations are arranged in concentric circles around the open end of the nipple and increase in length and width progressively from the innermost circle to the outermost circle.

2 Claims, 1 Drawing Sheet

(56) References Cited

U.S. PATENT DOCUMENTS

| | | | | |
|---|---|---|---|---|
| 2011/0000867 | A1* | 1/2011 | Lau | A61J 9/00 215/11.5 |
| 2013/0200031 | A1* | 8/2013 | Rees | A61J 11/006 215/11.4 |

FOREIGN PATENT DOCUMENTS

| | | | |
|---|---|---|---|
| EP | 1779833 | A1 | 5/2007 |
| EP | 2465484 | A1 | 6/2012 |
| JP | 2001009008 | A | 1/2001 |
| WO | 2006000816 | A1 | 1/2006 |

* cited by examiner

CAP FOR FEEDING BOTTLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention relates to a removable cap for the top of a feeding bottle used for babies. The cap carries an upstanding nipple which is open at the bottom for the inflow of the liquid bottle contents and an aperture at the top for the outflow of the contents into the baby's mouth when it sucks on the nipple.

2. Description of Related Art Including Information Disclosed Under 37 CFR 1.97 and 37 CFR 1.98.

The aim of the present invention is to provide such a cap which more realistically replicates the feel of a mother's breast and nipple than is achieved by conventional feeding bottles.

SUMMARY OF THE INVENTION

According to the invention, the removable cap is constructed of flexible plastics material and has a smooth exterior surface which is soft to the touch of the baby's lips and chin and an area of which surrounding the open end of the nipple is provided in its underside with a plurality of spaced shallow indentations which are elliptical in shape.

By means of the invention, the area of the cap around the nipple has an enhanced flexibility in comparison with the remainder of the cap and can flex and stretch upwardly together with the nipple while suction is applied, also allowing the nipple to tilt as the baby's mouth is moved. As a result, the nipple moves like a mother's nipple and affords baby a more natural breast-like feeding experience. When the suction ceases, the cap returns to its unflexed state.

The indentations are moulded into the cap during manufacture and the preferred plastics material is silicone.

BRIEF DESCRIPTION OF THE DRAWINGS

An example of the invention will now be described with reference to the accompanying drawing.

DETAILED DESCRIPTION OF THE DRAWINGS

Figure 1:
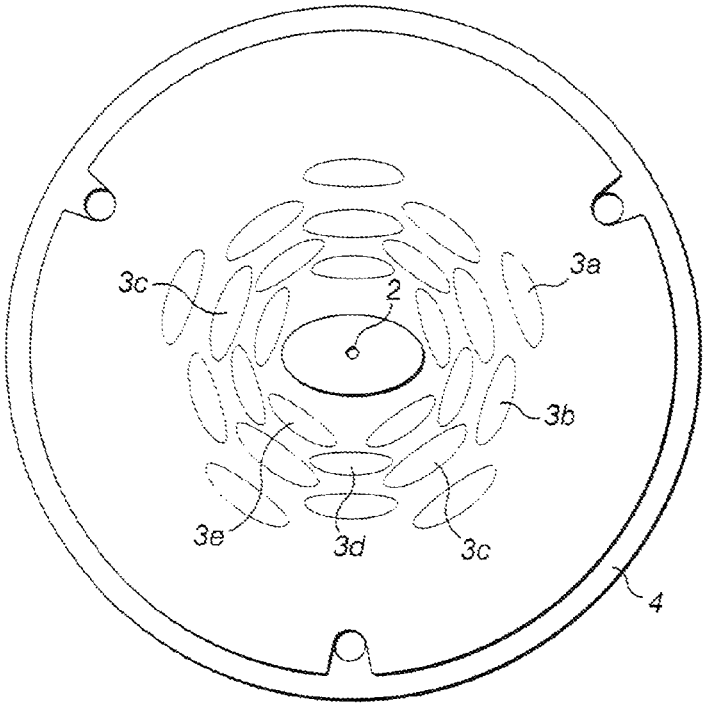
FIG. 1 is a bottom plan view of the cap when removed from the bottle.

The illustrated circular cap for applying to the top of a baby's feeding bottle is substantially segmentary domical in shape and moulded in silicone material with a smooth exterior surface which is soft to the touch of the baby's lips and chin. Upstanding from its apex there is an integral oval-shaped nipple 1 with an aperture 2. In the enlarged FIG. 1 view, only the interior of the nipple is visible through its open end.

In an area of the cap surrounding the open end of the nipple, the underside of the cap is provided with a plurality of spaced shallow elliptical indentations formed during moulding of the cap. As shown in the FIG. 1 embodiment, which illustrates a favourable arrangement of the indentations, they are disposed in five concentric circles around the nipple and they increase in length and width progressively from the indentations 3*e* in the innermost circle to the indentations 3*d*, 3*c*, 3*b* and finally 3*a* in the outermost circle. This arrangement has been found to be most effective.

Figure 2:
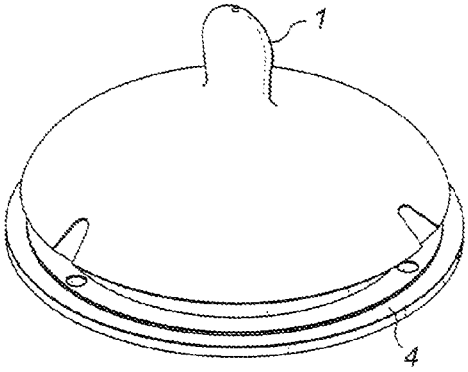
FIG. 2 is an upper perspective view of the cap.
Figure 3:
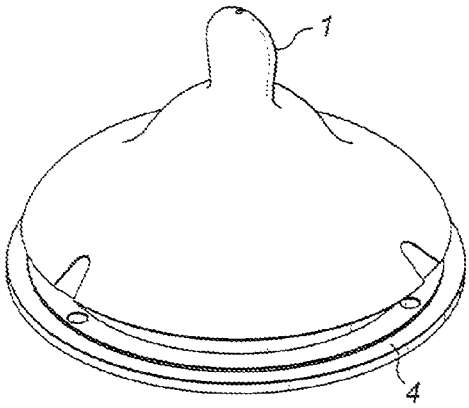
FIG. 3 is the same upper perspective view as in FIG. 2 but showing the cap as it would look when suction is applied at the nipple by the baby.

FIG. 3 illustrates the cap in its condition when suction s applied to the nipple 1, with the area supporting the nipple flexed and stretched to upstand from the remainder of the material whereas in FIG. 2 the cap is shown in its unflexed state.

The cap is removably attached to the neck of a feeding bottle by means of a separate ring (not shown) which engages a peripheral flange 4 on the cap.

I claim:

1. A removable cap for a top of a feeding bottle used for babies, comprising:

an upstanding nipple open at a bottom for inflow of liquid bottle contents;

an aperture at a top of the nipple for outflow of the contents, wherein the nipple is comprised of flexible plastics material, the nipple having a smooth exterior surface and an underside surface area surrounding said aperture; and a plurality of concentric circles on said underside surface area, each concentric circle being comprised of a plurality of spaced shallow indentations, each indentation being elliptical and moulded into the plastics material on said underside surface area, each indentation of a respective concentric circle having a respective size and being arranged end to end in the respective concentric circle, wherein each respective size of each respective indentation corresponds to each respective concentric circle, and wherein respective size increases as concentric circle size increases, an innermost concentric circle closest to said aperture having respective indentations with a smallest respective size.

2. The cap according to claim 1, wherein the flexible plastics material is comprised of silicone.

* * * * *